US011404018B2

(12) United States Patent
Wang

(10) Patent No.: US 11,404,018 B2
(45) Date of Patent: Aug. 2, 2022

(54) DISPLAY DEVICE PREVENTING DIMMING IN DISPLAY DURING LONG-TERM USE

(71) Applicants: HKC Corporation Limited, Shenzhen (CN); Chongqing HKC Optoelectronics Technology Co., ltd., Chongqing (CN)

(72) Inventor: Mingliang Wang, Chongqing (CN)

(73) Assignees: HKC Corporation Limited, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/417,473

(22) PCT Filed: May 6, 2020

(86) PCT No.: PCT/CN2020/088697

§ 371 (c)(1),
(2) Date: Jun. 23, 2021

(87) PCT Pub. No.: WO2020/224577

PCT Pub. Date: Nov. 12, 2020

(65) Prior Publication Data

US 2022/0059047 A1 Feb. 24, 2022

(30) Foreign Application Priority Data

May 6, 2019 (CN) ..... 201910371456.1

(51) Int. Cl.
*G09G 3/36* (2006.01)

(52) U.S. Cl.
CPC ... *G09G 3/3688* (2013.01); *G09G 2320/0276* (2013.01)

(58) Field of Classification Search
CPC ..... G09G 3/30; G09G 3/32; G09G 3/3208; G09G 3/3216; G09G 3/3225;
(Continued)

(56) References Cited

U.S. PATENT DOCUMENTS 7,071,905 B1 * 7/2006 Fan ..... G09G 3/3233 315/169.3
11,295,694 B2 * 4/2022 Wang ..... G09G 3/3696
(Continued)

FOREIGN PATENT DOCUMENTS

CN 102446475 A 5/2012
CN 104280970 A 1/2015
(Continued)

OTHER PUBLICATIONS

International Search Report from International Application No. PCT/CN2020/088697 dated Jun. 24, 2020.

*Primary Examiner* — Alexander Eisen
*Assistant Examiner* — Nelson Lam
(74) *Attorney, Agent, or Firm* — Hauptman Ham, LLP

(57) ABSTRACT

A display device comprises a power supply chip configured to output a gate-on voltage; a gamma chip configured to provide a gamma voltage; a detection resistor having a first terminal and a second terminal, wherein the first terminal is grounded; a display panel comprising a plurality of sub-pixels, a plurality of driving transistors and at least one detection transistor; wherein a gate electrode of the driving transistor receives the gate-on voltage, a first electrode of the driving transistor receives the gamma voltage, and a second electrode of the driving transistor is electrically connected to a corresponding sub-pixel; a gate electrode of the detection transistor receives the gate-on voltage, a first electrode of the detection transistor receives a test voltage, and a second electrode of the detection transistor is electrically connected
(Continued)

to the second terminal; and a control circuit electrically connected to the second terminal.

20 Claims, 4 Drawing Sheets

(58) Field of Classification Search
CPC .... G09G 3/3233; G09G 3/3241; G09G 3/325; G09G 3/3258; G09G 3/3266; G09G 3/3275; G09G 3/3283; G09G 3/3291; G09G 3/36; G09G 3/3611; G09G 3/364; G09G 3/3644; G09G 3/3648; G09G 3/3674; G09G 3/3677; G09G 3/3681; G09G 3/3696; G09G 2320/0276
USPC ..... 345/76–83, 87–104
See application file for complete search history.

(56) References Cited

U.S. PATENT DOCUMENTS

2003/0122813 A1* 7/2003 Ishizuki ..... G09G 3/3233 345/211
2005/0052350 A1* 3/2005 Mizukoshi ..... G09G 3/3233 345/55
2006/0055631 A1* 3/2006 Yoshida ..... G09G 3/3233 345/46
2010/0225634 A1* 9/2010 Levey ..... G09G 3/3208 345/212
2011/0074750 A1* 3/2011 Leon ..... G09G 3/3233 345/207
2011/0109660 A1* 5/2011 Kim ..... G09G 3/3291 345/690
2012/0019569 A1* 1/2012 Byun ..... G09G 3/3233 345/690
2012/0091997 A1 4/2012 Huang
2015/0325169 A1 11/2015 Qing et al.
2016/0098961 A1* 4/2016 Han ..... G09G 3/3291 345/83
2016/0133192 A1* 5/2016 Chae ..... G09G 3/3258 345/205
2022/0130942 A1* 4/2022 Kim ..... G09G 3/3233

FOREIGN PATENT DOCUMENTS

CN 104900186 A 9/2015
CN 106935193 A 7/2017
CN 109425816 A 3/2019
CN 110322850 A 10/2019
KR 20070042465 A 4/2007

* cited by examiner

DISPLAY DEVICE PREVENTING DIMMING IN DISPLAY DURING LONG-TERM USE

CROSS-REFERENCE TO RELATED APPLICATIONS

This application is a U.S. National Stage Application of PCT International Application No. PCT/CN2020/088697 filed on May 6, 2020, which claims priority of Chinese Patent Application No. 2019103714561, entitled "Display Device", filed on May 6, 2019, the entire content of each of which is incorporated herein in its entirety.

TECHNICAL FIELD

The present disclosure relates to the field of display technology, and especially to a display device.

BACKGROUND

This section provides background information related to the present disclosure which is not necessarily prior art.

With the development of display technology, various display devices (e.g., liquid crystal television) have been used in work and life of people, providing convenience for people. Generally, each imaging sub-pixel of a display device is driven via a thin film transistor (TFT). Such a TFT type display device has advantages of high responsivity, high brightness, high contrast and etc., and thus has currently become most popular display device.

However, a thin film transistor inside such a display device would gradually age with long term use, which would lead to insufficient charging of its sub-pixels for display. As such, there will be a problem of dark display, and thus the service life of the device will be adversely affected.

SUMMARY

According to various embodiments of the present disclosure, a display device is provided.

A display device includes:

a power supply chip configured to output a gate-on voltage;

a gamma chip configured to provide a gamma voltage;

a detection resistor having a first terminal and a second terminal, wherein the first terminal is grounded;

a display panel including a plurality of sub-pixels, a plurality of driving transistors and at least one detection transistor; wherein a gate of the driving transistor receives the gate-on voltage, a first electrode of the driving transistor receives the gamma voltage, a second electrode of the driving transistor is electrically connected to a corresponding sub-pixel, a gate of the detection transistor receives the gate-on voltage, a first electrode of the detection transistor receives a test voltage, and a second electrode of the detection transistor is electrically connected to the second terminal of the detection resistor;

a control circuit electrically connected to the second terminal of the detection resistor;

when the driving transistor is an N-type transistor, the first electrode is a drain electrode, the second electrode is a source electrode, and when the voltage of the detection resistor decreases, the control circuit controls the power supply chip to increase the output of the gate-on voltage;

when the driving transistor is a P-type transistor, the first electrode is a source electrode, the second electrode is a drain electrode, and when the voltage of the detection resistor decreases, the control circuit controls the power supply chip to decrease the output of the gate-on voltage.

A display device includes:

a gamma chip configured to output a gamma voltage;

a data driving chip electrically connected to the gamma chip and configured to output the gamma voltage according to a certain timing sequence;

a power supply chip configured to output a gate-on voltage and a power supply voltage of the data driving chip, wherein the power supply chip includes a digital-to-analog conversion circuit;

a detection resistor having a first terminal and a second terminal, wherein the first terminal is grounded;

a display panel including a plurality of sub-pixels, a plurality of driving transistors and at least one detection transistor; wherein a gate of the driving transistor receives the gate-on voltage, a drain of the driving transistor receives the gamma voltage, and a source of the driving transistor is electrically connected to a corresponding sub-pixel, a gate of the detection transistor receives the gate-on voltage, a drain of the detection transistor receives the power supply voltage of the data driving chip, and a source of the detection transistor is electrically connected to the second terminal of the detection resistor;

an analog-to-digital conversion circuit configured to convert the power supply voltage of the data driving chip and a voltage across the detection resistor into a corresponding digital signal, respectively;

a timing sequence control chip including a voltage memory and a controller; wherein the voltage memory is electrically connected to the controller and includes an initial code area and a plurality of step table code areas, the initial code area stores an initial voltage code, and each step table code area stores a different step code; the controller is electrically connected to the analog-to-digital conversion circuit and the voltage memory, and is configured to calculate a voltage difference between the test voltage and the voltage of the detection resistor, read the initial voltage code from the initial code area and a step code from a step table code area according to the voltage difference, add the initial voltage code and the step code to obtain a new voltage code, and then transmit the new voltage code to the digital-to-analog conversion circuit to output a corresponding gate-on voltage;

whenever the voltage difference is greater than a preset voltage difference value, the controller controls the power supply chip to increase the output of the gate-on voltage.

According to the aforementioned display device, due to the adding of the detection resistor and the detection transistor, the aging condition of the detection transistor can be detected according to the reduction of the voltage of the detection resistor, and the aging status of each driving transistor can be effectively reflected by the aging status of the detection resistor. Meanwhile, the aforementioned display device controls the power supply chip to increase or decrease the output of the gate-on voltage when the voltage of the detection resistor decreases, such that the gate voltage of each driving transistor can be increased or decreased, the absolute value of its gate-source voltage VGS can be increased, and the channel resistance of its conducting channel can be decreased when the impedance of the driving transistor increases due to its aging, and it can effectively prevent the second electrode current (the actual charging current) of each driving transistor from decreasing, and thus guaranteeing the brightness consistency of the display device during long-term use. Therefore, the display device according to the present disclosure can be effectively prevented from dimming in display due to long-term use.

DETAILED DESCRIPTION

The above objects, features and advantages of the present invention will become more apparent by describing in detail embodiments thereof with reference to the accompanying drawings. It should be understood that, the specific embodiments described herein are merely exemplary and not intended to limit this application.

Figure 1:
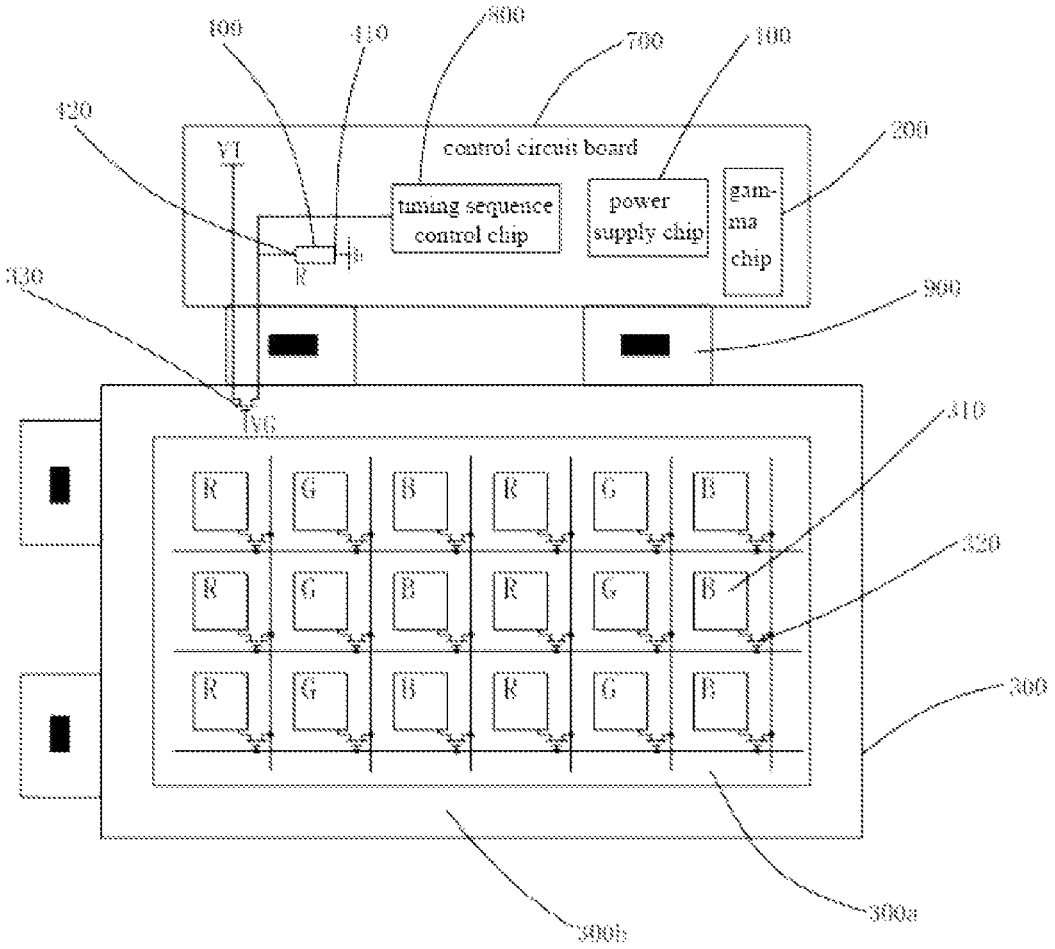
FIG. 1 is a schematic view of a display device of an embodiment.
Figure 2:
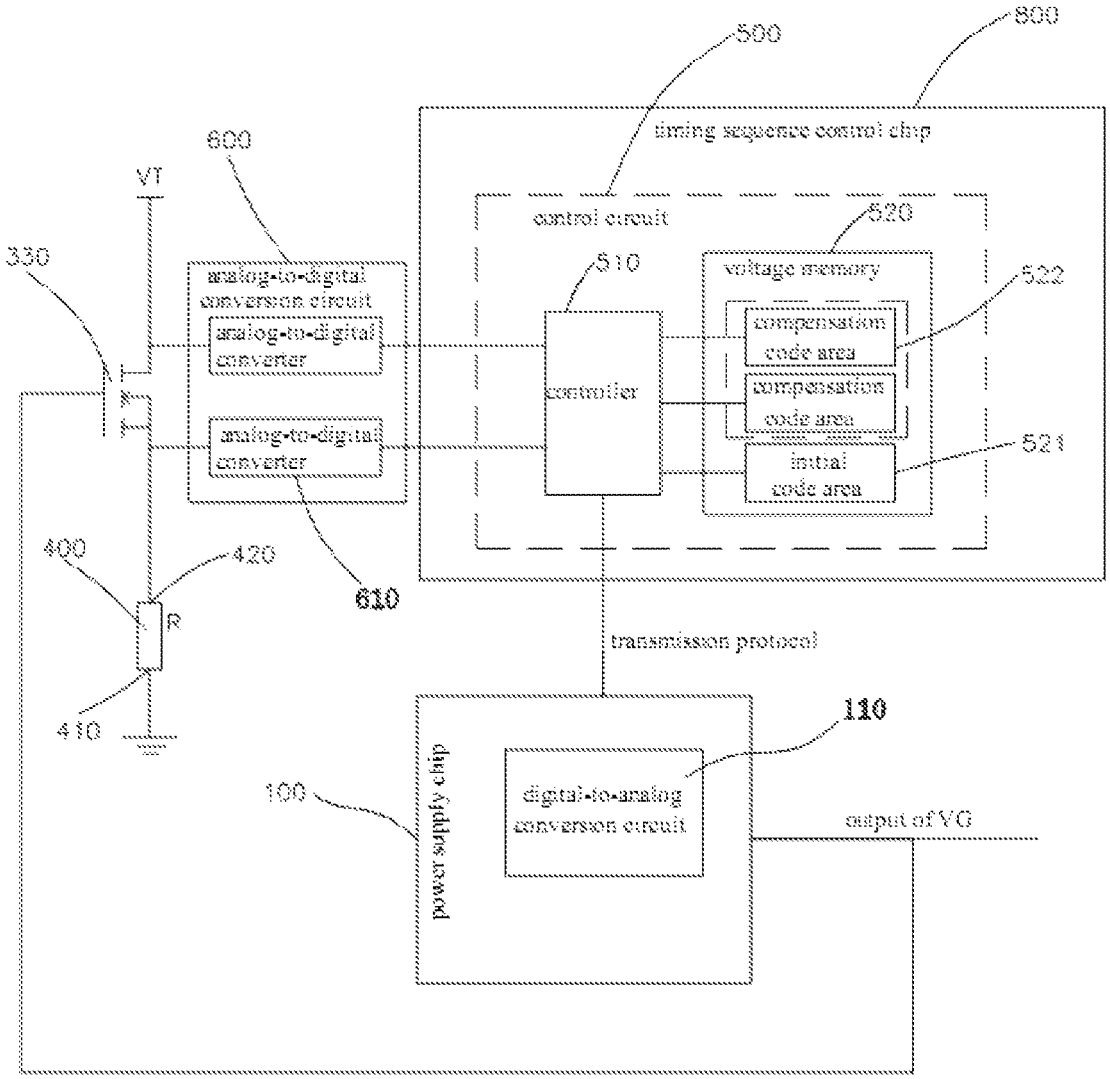
FIG. 2 is a partial enlarged view of the display device of FIG. 1.

Referring to FIGS. 1 and 2, in an embodiment, the display device includes a power supply chip 100, a gamma chip 200, and a display panel 300. The power supply chip 100 is configured to output a gate-on voltage VG. The gamma chip 200 is configured to output a gamma voltage.

The display panel 300 includes a plurality of sub-pixels 310 of various colors, such as red sub-pixel R, green sub-pixel G, and blue sub-pixel B. Meanwhile, the display panel 300 further includes a plurality of driving transistors 320 configured to drive the sub-pixels 310. The driving transistor 320 is an active array switch. Specifically, a gate of each driving transistor 320 receives the gate-on voltage VG to turn on a corresponding sub-pixel 310. A first electrode of each driving transistor 320 receives the corresponding gamma voltage to provide a power for a corresponding sub-pixel 310. A second electrode of each driving transistor 320 is electrically connected to a corresponding sub-pixel 310 to charge the corresponding sub-pixel 310. When the driving transistor 320 is an N-type transistor, the first electrode is a drain electrode and the second electrode is a source electrode. When the driving transistor 320 is a P-type transistor, the first electrode is a source electrode and the second electrode is a drain electrode.

In addition, in this embodiment, the display panel further includes at least one detection transistor 330. The detection transistor 330 is configured to perform an aging detection. The detection transistor 330 and the driving transistor 320 can be formed by the same process, such that the two transistors can have same performance parameters, and thus the aging condition of the detection transistor 330 can relatively precisely reflect the aging condition of the driving transistor 320.

In order to implement the aging detection of the detection transistor 330, the display device further includes a detection resistor 400. The detection resistor 400 is a resistor with a constant resistance, which has a first terminal 410 and a second terminal 420 for electrical connection. The first terminal 410 is grounded, and the second terminal 420 is electrically connected to a second electrode of the detection transistor 330.

Meanwhile, the gate of the driving transistor 320 is identical to the gate of the detection transistor 330, which also receives the gate-on voltage VG to form a conducting channel. The first electrode of the detection transistor 330 receives a test voltage VT so as to form a current path in the conducting channel between the first electrode and the second electrode. The test voltage VT can be directly output by the power supply chip 100, or, of course, can be output by another driving part.

An equivalent impedance of the detection transistor 330 is set to be R1, an impedance of the detection resistor 400 is set to be R, the test voltage VT is set to be VDD, and a voltage applied on the detection resistor 400 is set to be V1. As such, referring to FIG. 1, when there is only one detection transistor 330, $V1=VDD*R/(R+R1)$.

Of course, in order to increase the reliability of detection, the number of the detection transistors 330 can be more than one. Specifically, for example, three identical detection transistors 330 can be provided, which are connected in parallel and then connected to the detection resistor 400 in series. An equivalent impedance of each detection transistor 330 is also set to be R1. In this case, the voltage across the detection resistor satisfies $V1=VDD*R/(R+\frac{1}{3}R1)$. As such, the aging condition of each driving transistor 320 can be determined according to the average aging condition of the three detection transistors 330, and thus the reliability of detection is increased.

As can be seen from the above relationships, the voltage V1 across the detection resistor 400 is negatively correlated with the impedance R1 of the detection transistor 330. The driving transistor 320 is identical to the detection transistor 330, which is also gradually aged with the use of the display device, and the equivalent impedance R1 of which gradually increases. Accordingly, as this transistor ages, V1 will become smaller and smaller. As such, the aging degree of the detection transistor 330 can be detected from V1, which can in turn reflect the aging degree of the driving transistor 320.

Referring to FIG. 2, in this embodiment, the display device further includes a control circuit 500. The control circuit 500 is electrically connected to the second terminal 420 of the detection resistor 400, and thus it can control the gamma chip 200 to output a different gamma voltage according to the voltage of the detection resistor 400.

The driving transistor 320 and the detection transistor 320 are provided in a same display device, both of which receive a same gate-on voltage VG. Therefore, the two have a similar aging degree. The aging condition of the detection transistor 330 can reflect the aging condition of the driving transistor. When the voltage of the detection resistor 400 decreases, it means that the impedances of the detection transistor 330 and the driving transistor 320 increase due to aging.

In case that the driving transistor 320 is an N-type transistor, the control circuit 500 controls the power supply chip 100 to increase the output of the gate-on voltage VG. As such, when the impedance of the driving transistor 320 itself increases due to its aging, its gate voltage can be increased, and thus the absolute value of the gate-source voltage VGS can be increased, and the channel resistance of the conducting channel can be decreased. In the illustrated embodiment in FIG. 2, the driving transistor 320 is an N-type transistor.

In case that the driving transistor 320 is a P-type transistor, the control circuit 500 controls the power supply chip 100 to decrease the output of the gate-on voltage VG. As such, when the impedance of the driving transistor 320 itself increases due to its aging, its gate voltage will decrease, and thus the absolute value of the gate-source voltage VGS will increase, and the channel resistance of the conducting channel will decrease.

The decrease of the channel resistance of the conducting channel can effectively prevent a second electrode current (i.e., an actual charging current) of the driving transistor 320 flowing to a sub-pixel 210 from decreasing. As such, the present application can effectively prevent the display device from dimming in brightness after long-term use.

Referring to FIG. 2, in one embodiment, the control circuit 500 includes a controller 510 configured to control the output of the gate-on voltage VG. The display device also includes an analog-to-digital conversion circuit 600. The analog-to-digital conversion circuit 600 can convert an analog signal into a digital signal.

The analog-to-digital conversion circuit 600 has an input terminal configured to receive the voltage of the detection resistor 400, and an output terminal that is electrically connected to the controller 500. As such, the analog-to-digital conversion circuit 600 can convert the voltage of the detection resistor 400 into a digital signal to facilitate the controller to process such data (i.e., the voltage of the detection resistor 400).

Whenever the voltage of the detection resistor 400 is lower than a preset voltage value, it indicates that the aging of the detection transistor 330 causes the impedance of the detection transistor 330 to increase, which in turn causes the output second electrode current to decrease to a certain extent. In other words, the aging of the driving transistor causes the impedance to increase, which in turn causes the output second electrode current to decrease to a point where it can affect the brightness.

In case that the driving transistor 320 is an N-type transistor, the controller 500 controls the power supply chip 100 to increase the output of the gate-on voltage VG, so as to reduce the channel resistance of the conduction channel of the transistors (the detection transistor 330 and the driving transistor 320), and thus prevent the second electrode current from decreasing. "The preset voltage value" here can be set as required.

In case that the driving transistor 320 is a P-type transistor, the controller 500 controls the power supply chip 100 to decrease the output of the gate-on voltage VG, so as to reduce the channel resistance of the conduction channel of the transistors (the detection transistor 330 and the driving transistor 320), and thus prevent the second electrode current from decreasing. "The preset voltage value" herein can be set as required.

In another embodiment, the control circuit 500 also includes a controller 510 configured to control the output of the gate-on voltage VG. The display device also includes an analog-to-digital conversion circuit 600, an input terminal of the analog-to-digital conversion circuit 600 is also configured to acquire the voltage of the detection resistor 400, and an output terminal of the analog-to-digital conversion circuit 600 is electrically connected to the controller 500.

In addition to acquire the voltage of the detection resistor 400, the input terminal of the analog-to-digital conversion circuit 600 further acquires a test voltage VT. In this case, the analog-to-digital conversion circuit 600 can be configured to include two analog-to-digital converter 610. One of the analog-to-digital converter 610 acquires the voltage of the detection resistor 400, and the other analog-to-digital converter 610 acquires the test voltage VT. The controller 510 is also configured to calculate a voltage difference dV between the test voltage VT and the voltage of the detection resistor 400, and control the output of the gate-on voltage VG according to the voltage difference dV.

The voltage value of the test voltage VT is constant, and the voltage V1 of the detection resistor 400 decreases as the detection transistor 330 ages. As a result, the voltage difference dV between the test voltage VT and the voltage of the detection resistor 400 increases as the detection transistor 330 ages.

When the voltage difference dV is greater than the preset voltage difference, it indicates that the aging of the driving transistor 320 causes the impedance of the driving transistor 320 to increase, which in turn causes the output second electrode current to decrease and thus affect the display brightness of the display device.

In case that the driving transistor 320 is an N-type transistor, the controller 500 controls the power supply chip 100 to increase the output of the gate-on voltage VG, so as to reduce the channel resistance of the conduction channel of the transistors (the detection transistor 330 and the driving transistor 320), and thus prevent the second electrode current from decreasing. "The preset voltage difference" herein can be set as required.

In case that the driving transistor 320 is a P-type transistor, the controller 500 controls the power supply chip 100 to decrease the output of the gate-on voltage VG, so as to reduce the channel resistance of the conduction channel of the transistors (the detection transistor 330 and the driving transistor 320), and thus prevent the second electrode current from decreasing. "The preset voltage difference" herein can be set as required.

There is an error when the analog-to-digital conversion circuit 600 performs a conversion from an analog signal to a digital signal. In this embodiment, both the test voltage VT and the voltage of the detection resistor 400 are acquired. Both of the voltages are converted by the analog-to-digital conversion circuit 600 into digital signals, and then a difference between them is obtained, which can reduce the conversion error from the analog-to-digital conversion circuit 600 to obtain a more accurate result. As such, the controller 510 can control the power supply chip 100 to output the gate turn-on voltage VG more accurately.

In the embodiment as described above, the controller 510 receives the digital signals that have been converted by the analog-to-digital conversion circuit 600. In another embodiment, the controller 510 can also directly receive the analog signals (the voltage of the detection resistor 400 and the test voltage VT).

There may also be several manners for the controller 510 to control the power supply chip 100 to increase (or decrease) the gate-on voltage VG.

Referring to FIG. 2 again, in an embodiment, the control circuit 500 includes a controller 510 and a voltage memory 520. The power supply chip 100 further includes a digital-to-analog conversion circuit 110. The voltage memory 520 is electrically connected to the controller 510 and includes an initial code area 521 and at least one compensation code area 522. The initial code area 521 stores an initial voltage code. If there is more than one compensation code area 522, then each compensation code area 522 stores a different compensation voltage code.

When the voltage of the detection resistor 400 decreases, the controller 510 reads the initial voltage code from the initial code area 521 and the compensation voltage code from the compensation code area 522, add the initial voltage code and the compensation voltage code to obtain a new voltage code, and then transmit the new voltage code to the digital-to-analog conversion circuit 110 to output a corresponding gate-on voltage VG. Specifically, the controller 510 can perform such transmission via a certain transmission protocol or the like.

Specifically, in case that the driving transistor is an N-type transistor, when the display device just begins to be used, the voltage V1 of the detection resistor 400 is greater than a preset voltage value (or the voltage difference between the test voltage VT, and the voltage V1 of the detection resistor 400 is greater than the preset voltage difference). At this point, the power supply chip 100 can directly output an initial gate-on voltage VG.

After the display device has been used for a period of time, the voltage V1 of the detection resistor 400 becomes lower than the preset voltage value (or the voltage difference between the test voltage VT and the voltage V1 of the detection resistor 400 is greater than the preset voltage difference). At this point, the control circuit 500 reads the initial voltage code from the initial code area 521 and a compensation voltage code from a compensation code area 522 to control the power supply chip 100 to output an increased gate-on voltage, such that the display device can be prevented from dimming.

When there is more than one compensation code area 522, likewise, after the display device has been used for a further period of time, the voltage V1 of the detection resistor 400 becomes lower than the preset voltage value (or the voltage difference (VT−V1) between the test voltage VT and the voltage V1 of the detection resistor 400 is greater than the preset voltage difference) once again. At this point, the control circuit 500 reads the initial voltage code from the initial code area 521 and a compensation voltage code from another compensation code area 522 to output another higher gate-on voltage, such that the display device can be prevented from dimming, and so on, which is similar to the step as described above.

In an embodiment of the present disclosure, the compensation code area 522 may be set as a step table code area, and the compensation voltage code may be set as step codes. The step codes can gradually increase the gate-on voltage VG. The controller 510 can gradually increase the output of the gate-on voltage VG according to the voltage difference dV.

Specifically, when the voltage V1 of the detection resistor 400 is lower than the preset voltage value (or the voltage difference between the test voltage VT and the voltage V1 of the detection resistor 400 is greater than the preset voltage difference), i.e. the gate-on voltage VG is insufficient, the gate-on voltage VG is increased by a ΔVG for a first time. If the gate-on voltage VG is still detected to be insufficient, i.e. the voltage V1 of the detection resistor 400 is still lower than the preset voltage value (or the voltage difference between the test voltage VT and the voltage V1 of the detection resistor 400 is greater than the preset voltage difference), the gate-on voltage VG is increased by a ΔVG for a second time (that is, it is increased by two ΔVGs) and output. The gate-on voltage VG is accumulated in turn until it becomes sufficient, that is, until the voltage V1 of the detection resistor 400 is not lower than the preset voltage value (or the voltage difference between the test voltage VT and the voltage V1 of the detection resistor 400 is not greater than the preset voltage difference).

In this case, the adjustment accuracy of the gate-on voltage VG can be guaranteed, such that it will not increase too much at once. Further, it can realize an intelligent increase of a different ΔVG under a different aging degree, such that the gate-on voltage VG can be changed from insufficient to sufficient, and the aging of the driving transistor 320 can be compensated more perfectly.

Of course, in an embodiment of the present disclosure, the compensation code area 522 may not be set as a step table code area. For example, the gate-on voltage VG may be increased by a same ΔVG every time it is insufficient, until the gate-on voltage VG is changed from insufficient to sufficient. The present disclosure is not limited to this.

In another embodiment, the structure of the voltage memory 520 may be different from that as described in the above embodiment.

Figure 3:
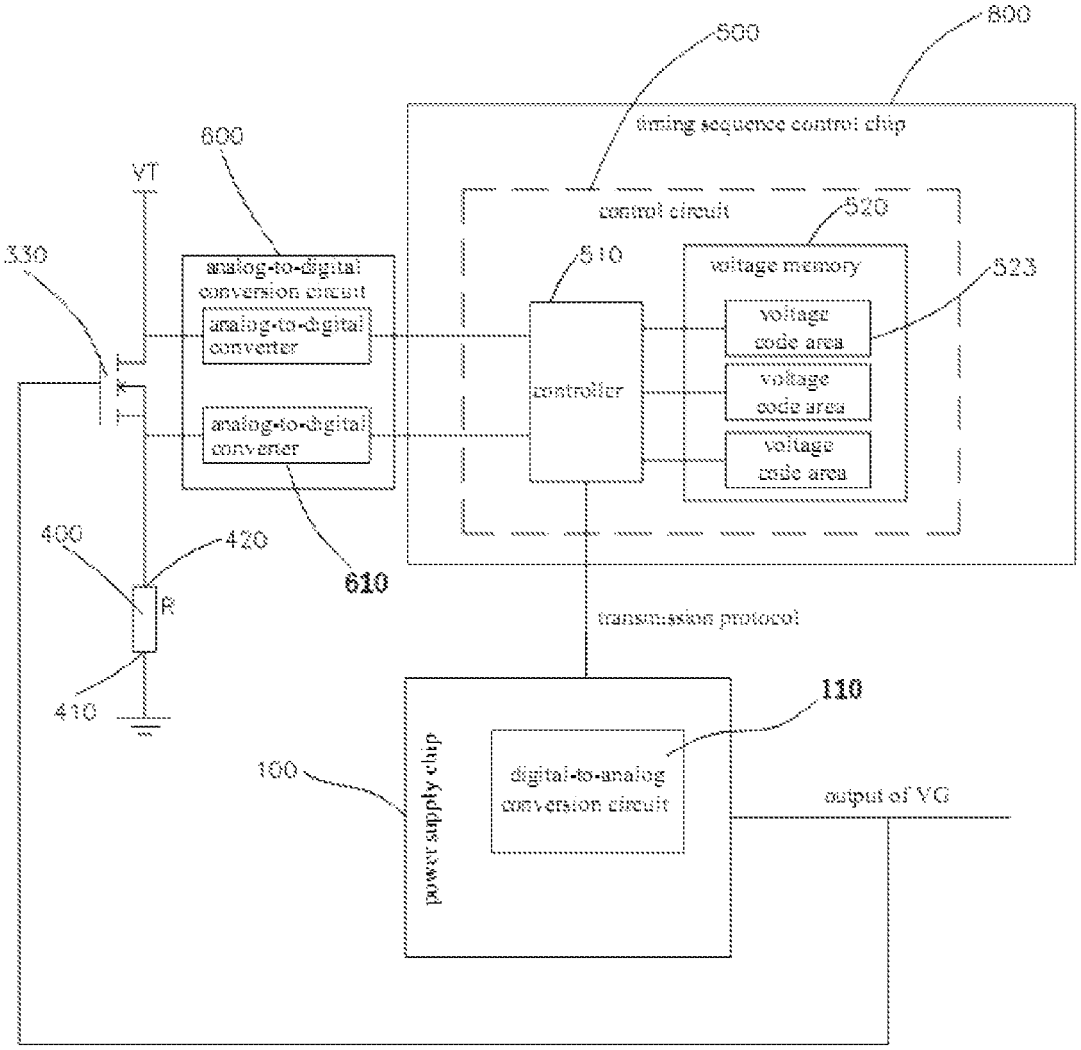
FIG. 3 is a partial enlarged view of a display device of another embodiment.

Referring to FIG. 3, the voltage memory 520 includes at least one voltage code area 523. The voltage code area 523 directly stores a new voltage code. When there is more than one voltage code area 523, a different voltage code area 523 stores a different new voltage code. When the voltage of the detection resistor decreases, the controller 510 is configured to read a new voltage code from a voltage code area 523, and transmit the new voltage code to the digital-to-analog conversion circuit 110 to output a corresponding gate-on voltage VG.

In this case, each voltage code area 523 directly stores a new voltage code that is corresponding to a different gate-on voltage VG, and thus the controller 510 can directly read the new voltage codes. As such, in this embodiment, the control process of the controller 510 can be simplified, and the storage space of the voltage memory 520 can be saved.

Referring to FIG. 1, in an embodiment, the display device further includes a control circuit board 700. The power supply chip 100, the gamma chip 200, the detection resistor 400, and the control circuit 500 are all arranged on the control circuit board 600. That is, the detection resistor 400 and the control circuit 500 can be arranged on a control circuit board 600 where the power supply chip 100 and the gamma chip 200 are located to facilitate the circuit layout of the resistor.

Specifically, the display device may further include a timing sequence control chip 800 which is also located on the control circuit board 600. Specifically, the control circuit 500 can be located within the timing sequence control chip 800. In this case, the controller 500 can be a central processor of the timing sequence control chip 800, and thus the system compatibility can be increased.

Referring to FIG. 1 again, in an embodiment, the display panel 300 has a display area **300*a* and a non-display area 300*b* surrounding the display area 300*a*. The sub-pixels 310 and the driving transistors 320 are located in the display area 300*a*, and thus can be displayed in the display area. The detection transistor 330 is located in the non-display area 300*b* to reduce its affection to the wiring, light emission and etc. of the display area 300*a***.

Referring to FIG. 1 again, in an embodiment, the display device further includes a data driving chip 900. The data driving chip 900 is electrically connected to the gamma chip 200 and the driving transistors 320 so as to output the gamma voltage from the gamma chip 200 to the driving transistors 320 according to a certain timing sequence.

The power supply voltage of the data driving chip 900 is output by the power supply chip 100, which is similar to the gamma voltage output for normal displaying. Accordingly, in the present disclosure, the power supply voltage of the data driving chip 900 is taken as the test voltage VT. On one hand, it is not necessary to output an additional voltage, which makes the system more compatible. On the other hand, the detection transistor 330 has a closer operation condition to that of the driving transistor 320, and thus the aging of the detection transistor 330 can reflect the aging condition of the driving transistor 320 more accurately.

Figure 4:
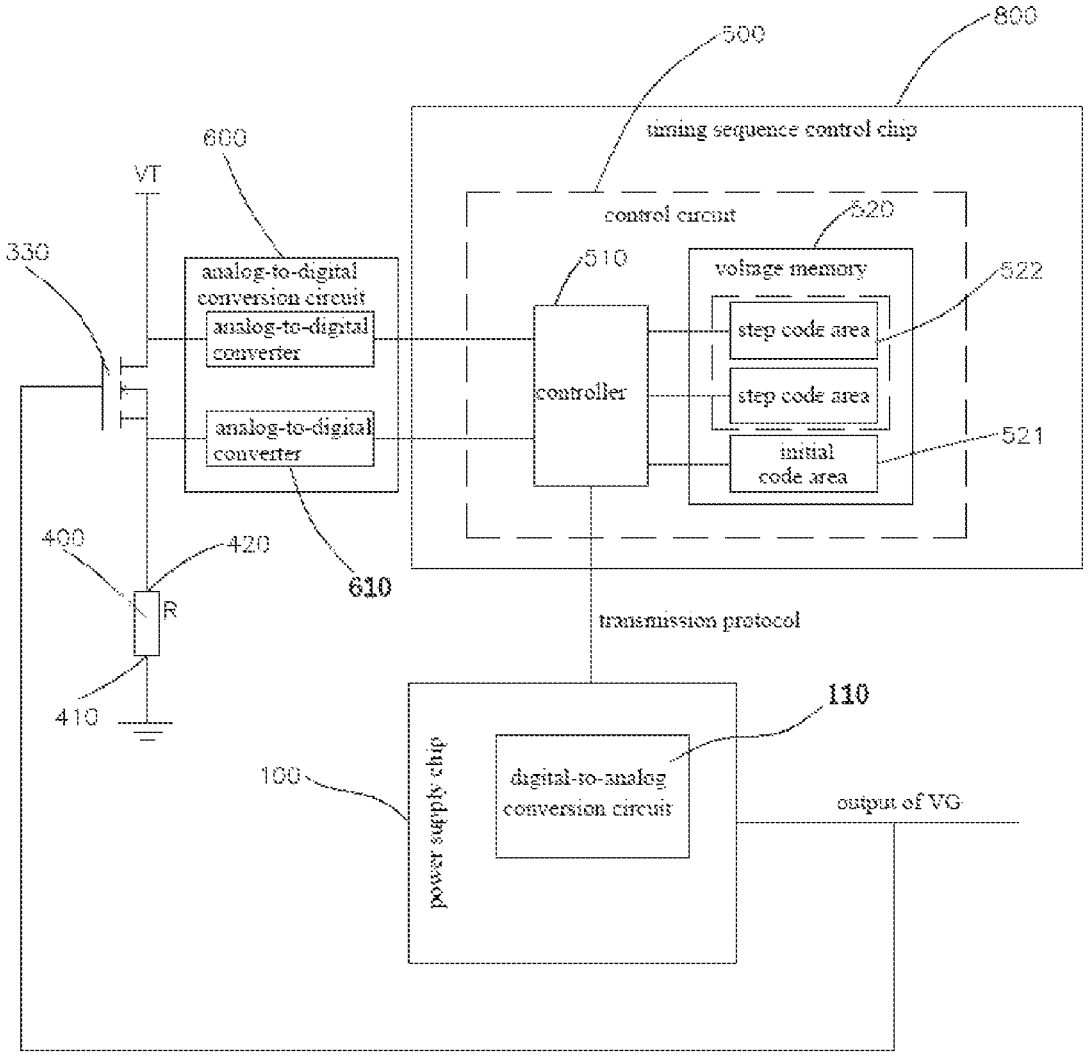
FIG. 4 is a partial enlarged view of a display device of yet another embodiment.

Referring to FIG. 1 and FIG. 4, in another embodiment, the display device includes a gamma chip 200, a data driving chip 900, a power supply chip 100, a detection resistor 400, a display panel 300, an analog-to-digital conversion circuit 600, and a timing sequence control chip 800.

The gamma chip 200 is configured to output a gamma voltage. The data driving chip 900 is electrically connected to the gamma chip 200 and is configured to output the gamma voltage according to a certain timing sequence. The power supply chip 100 is configured to output a gate-on voltage VG and a power supply voltage of the data driving chip 900. And the power supply chip 100 includes a digital-to-analog conversion circuit 110. The detection resistor 400 has a first terminal 410 and a second terminal 420 for electrical connection, and wherein the first terminal 410 is grounded.

The display panel 300 includes a plurality of sub-pixels 310, a plurality of driving transistors 320, and at least one detection transistor 330. The driving transistor 320 is an N-type transistor. A gate of the driving transistor receives the gate-on voltage VG, and a drain of the driving transistor receives the gamma voltages. A source of the driving transistor 320 is electrically connected to a corresponding sub-pixel 310. A gate of the detection transistor 330 receives the gate-on voltage VG. A drain of the detection transistor 330 receives the power supply voltage of the data driving chip. A source of the detection transistor 330 is electrically connected to the second terminal 420 of the detection resistor 400.

The analog-to-digital conversion circuit 600 is configured to convert the power supply voltage of the data driving chip 700 and the voltage across the detection resistor 400 into corresponding digital signals.

The timing sequence control chip 800 includes a voltage memory 520 and a controller 510. The voltage memory 520 is electrically connected to the controller 510, and includes an initial code area 521 and a plurality of step table code areas 522. The initial code area 521 stores an initial voltage code. Each step table code area 522 stores a different step code. The controller 510 is electrically connected to the analog-to-digital conversion circuit 600 and the voltage memory 520, which is configured to calculate a voltage difference between the test voltage VT and the voltage of the detection resistor 400, read the initial voltage code from the initial code area 521 and a step code from a step table code area 522 according to the voltage difference, add the initial voltage code and the step code to obtain a new voltage code, and then transmit the new voltage code to the digital-to-analog conversion circuit 110 to output a corresponding gate-on voltage VG.

When the voltage difference is greater than a preset voltage difference, the controller 510 controls the power chip 100 to increase the output of the gate-on voltage VG. "The preset voltage difference" can be set herein as required. Hence, in this embodiment, the output of the gate-on voltage VG can be increased to prevent the brightness from decreasing when the driving transistor 320 is seriously aged due of long term use of the display device.

The technical features in the above embodiments can be combined in any manner. In an effort to provide a concise description, not all of the possible combinations of the technical features in the above embodiments are described. However, any combination of these technical features should be considered within the scope as recited in this specification unless there is a contradiction in such a combination.

The embodiments as described above merely express several implementations of the present application, the description of which is relatively specific and detailed and should not be understood as a limitation to the scope of the invention. It should be pointed out that, it is possible for those skilled in the art to make several modifications and improvements to this application without departing from the concept of it, all of which are within the protection scope of this application. Therefore, the protection scope of this application shall be subject to that of the appended claims.

What is claimed is:

1. A display device, comprising:

a power supply chip configured to output a gate-on voltage;

a gamma chip configured to provide a gamma voltage;

a detection resistor having a first terminal and a second terminal, wherein the first terminal is grounded;

a display panel comprising a plurality of sub-pixels, a plurality of driving transistors and at least one detection transistor; wherein a gate of a driving transistor receives the gate-on voltage, a first electrode of the driving transistor receives the gamma voltage, a second electrode of the driving transistor is electrically connected to a corresponding sub-pixel, a gate of a detection transistor receives the gate-on voltage, a first electrode of the detection transistor receives a test voltage, and a second electrode of the detection transistor is electrically connected to the second terminal of the detection resistor; and a control circuit electrically connected to the second terminal of the detection resistor, wherein when the driving transistor is an N-type transistor, the first electrode is a drain electrode, the second electrode is a source electrode, and when a voltage of the detection resistor decreases, the control circuit controls the power supply chip to increase the output of the gate-on voltage;

when the driving transistor is a P-type transistor, the first electrode is a source electrode, the second electrode is a drain electrode, and when the voltage of the detection resistor decreases, the control circuit controls the power supply chip to decrease the output of the gate-on voltage;

the control circuit comprises a controller and a voltage memory, and the power supply chip further comprises a digital-to-analog conversion circuit;

the voltage memory is electrically connected to the controller and comprises at least one voltage code area, and the voltage code area stores a new voltage code; and when the voltage of the detection resistor decreases, the controller is configured to read the new voltage code from the voltage code area, and transmit the new voltage code to the digital-to-analog conversion circuit to output a corresponding gate-on voltage.

2. The display device according to claim 1, wherein the controller is configured to control the output of the gate-on voltage;

the display device further comprises an analog-to-digital conversion circuit, an input terminal of the analog-to-digital conversion circuit is configured to acquire the voltage of the detection resistor, and an output terminal of the analog-to-digital conversion circuit is electrically connected to the controller;

when the driving transistor is an N-type transistor, when the voltage of the detection resistor is lower than a preset voltage value, the controller controls the power supply chip to increase the output of the gate-on voltage; and when the driving transistor is a P-type transistor, when the voltage of the detection resistor is lower than the preset voltage value, the controller controls the power supply chip to decrease the output of the gate-on voltage.

3. The display device according to claim 1, wherein the controller is configured to control the output of the gate-on voltage;

the display device further comprises an analog-to-digital conversion circuit, wherein input terminals of the analog-to-digital conversion circuit are configured to acquire a test voltage and the voltage of the detection resistor, and an output terminal of the analog-to-digital conversion circuit is electrically connected to the controller;

the controller is further configured to calculate a voltage difference between the test voltage and the voltage of the detection resistor;

when the driving transistor is an N-type transistor, when the voltage difference is greater than a preset voltage difference, the controller controls the power supply chip to increase the output of the gate-on voltage; and when the driving transistor is a P-type transistor, when the voltage difference is greater than a preset voltage difference, the controller controls the power supply chip to decrease the output of the gate-on voltage.

4. The display device according to claim 1, wherein the display device further comprises a control circuit board, and the power supply chip, the gamma chip, the detection resistor, and the control circuit are all arranged on the control circuit board.

5. The display device according to claim 1, wherein the display panel comprises a display area and a non-display area surrounding the display area, the driving transistors are located in the display area, and the detection transistor is located in the non-display area.

6. The display device according to claim 1, wherein the display device further comprises a data driving chip, the data driving chip is electrically connected to the gamma chip and the driving transistor, and is configured to output the gamma voltage to the driving transistor according to a certain timing sequence; and the test voltage is a power supply voltage of the data driving chip.

7. The display device according to claim 1, wherein the gate of the detection transistor receives the gate-on voltage to form a conducting channel, and the first electrode of the detection transistor receives the test voltage to form a current path in the conducting channel between the first electrode and the second electrode of the detection transistor.

8. The display device according to claim 1, wherein three detection transistors are connected in parallel and then connected to the detection resistor in series, an equivalent impedance of each of the three detection transistors is R1, an impedance of the detection resistor is R, such that the voltage applied on the detection resistor satisfies $V1=VDD*R/(R+\frac{1}{3}R1)$, where VDD is the test voltage.

9. A display device, comprising:

a gamma chip configured to output a gamma voltage;

a data driving chip electrically connected to the gamma chip and configured to output the gamma voltage according to a certain timing sequence;

a power supply chip configured to output a gate-on voltage and a power supply voltage of the data driving chip, wherein the power supply chip comprises a digital-to-analog conversion circuit;

a detection resistor having a first terminal and a second terminal, wherein the first terminal is grounded;

a display panel comprising a plurality of sub-pixels, a plurality of driving transistors and at least one detection transistor; wherein a gate of a driving transistor receives the gate-on voltage, a drain of the driving transistor receives the gamma voltage, a source of the driving transistor is electrically connected to a corresponding sub-pixel, a gate of a detection transistor receives the gate-on voltage, a drain of the detection transistor receives the power supply voltage of the data driving chip, and a source of the detection transistor is electrically connected to the second terminal of the detection resistor;

an analog-to-digital conversion circuit configured to convert the power supply voltage of the data driving chip and a voltage across the detection resistor into a corresponding digital signal, respectively;

a timing sequence control chip comprising a voltage memory and a controller;

wherein the voltage memory is electrically connected to the controller and comprises an initial code area and a plurality of step table code areas, the initial code area stores an initial voltage code, and each step table code area stores a different step code;

the controller is electrically connected to the analog-to-digital conversion circuit and the voltage memory, and is configured to calculate a voltage difference between the test voltage and the voltage of the detection resistor, read the initial voltage code from the initial code area and a step code from a step table code area according to the voltage difference, add the initial voltage code and the step code to obtain a new voltage code, and transmit the new voltage code to the digital-to-analog conversion circuit to output a corresponding gate-on voltage; and when the voltage difference is greater than a preset voltage difference, the controller controls the power supply chip to increase the output of the gate-on voltage.

10. The display device according to claim 9, further comprising a control circuit board, and the power supply chip, the gamma chip, the detection resistor, and the control circuit are all arranged on the control circuit board.

11. The display device of claim 9, wherein the display panel comprises a display area and a non-display area surrounding the display area, the driving transistors are located in the display area, and the detection transistor is located in the non-display area.

12. The display device according to claim 9, wherein the gate of the detection transistor receives the gate-on voltage to form a conducting channel, and the first electrode of the detection transistor receives the test voltage to form a current path in the conducting channel between the first electrode and the second electrode of the detection transistor.

13. The display device according to claim 9, wherein three detection transistors are connected in parallel and then connected to the detection resistor in series, an equivalent impedance of each of the three detection transistors is R1, an impedance of the detection resistor is R, such that the voltage applied on the detection resistor satisfies $V1=VDD*R/(R+\frac{1}{3}R1)$, where VDD is the test voltage.

14. A display device, comprising:

a power supply chip configured to output a gate-on voltage;

a gamma chip configured to provide a gamma voltage;

a detection resistor having a first terminal and a second terminal, wherein the first terminal is grounded;

a display panel comprising a plurality of sub-pixels, a plurality of driving transistors and at least one detection transistor; wherein a gate of a driving transistor receives the gate-on voltage, a first electrode of the driving transistor receives the gamma voltage, a second electrode of the driving transistor is electrically connected to a corresponding sub-pixel, a gate of a detection transistor receives the gate-on voltage, a first electrode of the detection transistor receives a test voltage, and a second electrode of the detection transistor is electrically connected to the second terminal of the detection resistor; and a control circuit electrically connected to the second terminal of the detection resistor, wherein when the driving transistor is an N-type transistor, the first electrode is a drain electrode, the second electrode is a source electrode, and when a voltage of the detection resistor decreases, the control circuit controls the power supply chip to increase the output of the gate-on voltage;

when the driving transistor is a P-type transistor, the first electrode is a source electrode, the second electrode is a drain electrode, and when the voltage of the detection resistor decreases, the control circuit controls the power supply chip to decrease the output of the gate-on voltage;

the control circuit comprises a controller and a voltage memory, and the power supply chip further comprises a digital-to-analog conversion circuit;

the voltage memory is electrically connected to the controller and comprises an initial code area and at least one compensation code area, the initial code area stores an initial voltage code, and the compensation code area stores a compensation voltage code; and when the voltage of the detection resistor decreases, the controller is configured to read the initial voltage code from the initial code area and the compensation voltage code from the compensation code area, add the initial voltage code and the compensation voltage code to obtain a new voltage code, and transmit the new voltage code to the digital-to-analog conversion circuit to output a corresponding gate-on voltage.

15. The display device according to claim 14, wherein the controller is configured to control the output of the gate-on voltage;

the display device further comprises an analog-to-digital conversion circuit, an input terminal of the analog-to-digital conversion circuit is configured to acquire the voltage of the detection resistor, and an output terminal of the analog-to-digital conversion circuit is electrically connected to the controller;

when the driving transistor is an N-type transistor, when the voltage of the detection resistor is lower than a preset voltage value, the controller controls the power supply chip to increase the output of the gate-on voltage; and when the driving transistor is a P-type transistor, when the voltage of the detection resistor is lower than the preset voltage value, the controller controls the power supply chip to decrease the output of the gate-on voltage.

16. The display device according to claim 14, wherein the controller is configured to control the output of the gate-on voltage;

the display device further comprises an analog-to-digital conversion circuit, wherein input terminals of the analog-to-digital conversion circuit are configured to acquire the test voltage and the voltage of the detection resistor, and an output terminal of the analog-to-digital conversion circuit is electrically connected to the controller;

the controller is further configured to calculate a voltage difference between the test voltage and the voltage of the detection resistor;

when the driving transistor is an N-type transistor, when the voltage difference is greater than a preset voltage difference, the controller controls the power supply chip to increase the output of the gate-on voltage; and when the driving transistor is a P-type transistor, when the voltage difference is greater than the preset voltage difference, the controller controls the power supply chip to decrease the output of the gate-on voltage.

17. The display device according to claim 14, wherein the compensation code area is a step table code area, the compensation voltage code is a step code, and the controller is configured to gradually control the output of the gate-on voltage according to a voltage difference.

18. The display device according to claim 14, wherein the display panel comprises a display area and a non-display area surrounding the display area, the driving transistors are located in the display area, and the detection transistor is located in the non-display area.

19. The display device according to claim 14, wherein the display device further comprises a data driving chip, the data driving chip is electrically connected to the gamma chip and the driving transistor, and is configured to output the gamma voltage to the driving transistor according to a certain timing sequence; and the test voltage is a power supply voltage of the data driving chip.

20. The display device according to claim 14, wherein three detection transistors are connected in parallel and then connected to the detection resistor in series, an equivalent impedance of each of the three detection transistors is R1, an impedance of the detection resistor is R, such that the voltage applied on the detection resistor satisfies $V1=VDD*R/(R+\frac{1}{3}R1)$, where VDD is the test voltage.

* * * * *